US005647737A

United States Patent [19]

Gardner et al.

[11] Patent Number: 5,647,737

[45] Date of Patent: Jul. 15, 1997

[54] RECIPROCATING PUMP WITH SIMPLIFIED SEAL REPLACEMENT

[75] Inventors: Richard K. Gardner, Montpelier; Roger D. Wieland, Bryan; Mark D. Jermeay, Farmer, all of Ohio

[73] Assignee: Ingersoll-Rand Company, Woodcliff Lake, N.J.

[21] Appl. No.: 604,148

[22] Filed: Feb. 20, 1996

[51] Int. Cl.[6] ..... F04B 53/22

[52] U.S. Cl. ..... 417/454; 417/554

[58] Field of Search ..... 417/454, 360, 417/554, 567, 569

[56] References Cited

U.S. PATENT DOCUMENTS

| | | | |
|---|---|---|---|
| 2,281,933 | 5/1942 | Gage | 417/554 |
| 2,404,502 | 7/1946 | Kehle | 417/554 |
| 4,775,303 | 10/1988 | Liska | 417/554 |
| 5,435,697 | 7/1995 | Guebeli et al. | 417/554 |

FOREIGN PATENT DOCUMENTS

| | | | |
|---|---|---|---|
| 1284307 | 11/1968 | Germany | 417/554 |
| 633151 | 2/1962 | Italy | 417/554 |

OTHER PUBLICATIONS

Orion Sales Brochure for Reciprocating Pumps, 1993.

Graco Sales Brochure for Double Acting Oil Pumps, 1994.

*Primary Examiner*—Roland McAndrews

*Attorney, Agent, or Firm*—Michael M. Gnibus

[57] ABSTRACT

A reciprocating pump, comprising a reciprocating motor having a housing body which includes an open first end and a base at the first end, the base substantially closes the first end of the motor housing. The motor also includes a reciprocating member movable by the motor. The member has an end and is adapted to be movable through a housing body chamber. The reciprocating pump includes a pump outlet having a first end, a second end, a pumped fluid outlet port between the ends, and a passageway joining said ends and adapted to receive the end of the reciprocating member. The passageway has a minimum width and the outlet body is connected to the pump base. The reciprocating pump also includes a pump member adapted to be flow connected to the second end of the outlet body. The pump member has a movable check for displacing the pumped fluid to the outlet, said movable check being operatively connected to said end of said reciprocating member and said check also having a width that is less than the minimum width of the passage so that the check is serviceable with the reciprocating pump in line.

7 Claims, 2 Drawing Sheets

RECIPROCATING PUMP WITH SIMPLIFIED SEAL REPLACEMENT

FIELD OF THE INVENTION

This invention generally relates to a reciprocating pump, and more particularly to an improved reciprocating pump having an outlet body which permits the pump seals to be serviceable in-line, without disconnecting the pump outlet body from plumbing.

DESCRIPTION OF THE PRIOR ART

Reciprocating pumps are operatively connected to a reciprocating drive means such as a piston type motor by a piston tube. The piston tube is directly connected to the base of the motor. The piston tube encloses a reciprocating pump member which includes a number of seals. Known pump tubes are unitary and serve as the base of the motor and also the fluid outlet. It is difficult to check the seals and provide routine seal maintenance since it is necessary to disconnect the reciprocating pump, including the piston tube from supply plumbing in order to gain access to the seals.

The foregoing illustrates limitations known to exist in present devices and methods. Thus, it is apparent that it would be advantageous to provide an alternative directed to overcoming one or more of the limitations set forth above. Accordingly, a suitable alternative which permits the reciprocating pump to be serviced in-line without being disconnected from supply pluming is provided including features more fully disclosed hereinafter.

SUMMARY OF THE INVENTION

In one aspect of the present invention, this is accomplished by providing a pump tube including a reciprocating pump, comprising a reciprocating power source having a housing body which includes an open first end and a base at the first end, the base substantially closes the first end of the housing body. The power source is connected to a reciprocating member movable by the power source. The reciprocating member has an end and is adapted to be movable through a housing body chamber. The pump includes a pump outlet body having a first end, a second end, a pumped based, a pumped fluid outlet port between the ends, and a passageway joining said ends and adapted to receive the end of the reciprocating member. The passageway has a minimum width and the outlet body is connected to the pump base. A connecting means connects the outlet body to the motor housing base. The pump also includes a pump means adapted to be flow connected to the second end of the outlet body. The pump means has a movable means for displacing the pumped fluid to the outlet, said movable means being operatively connected to said end of said reciprocating member and said means also having a width that is less than the minimum width of the passage so that the means is serviceable with the pump in line. Therefore the reciprocating pump does not have to be disconnected from the supply plumbing in order to service the pump seals.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 1:
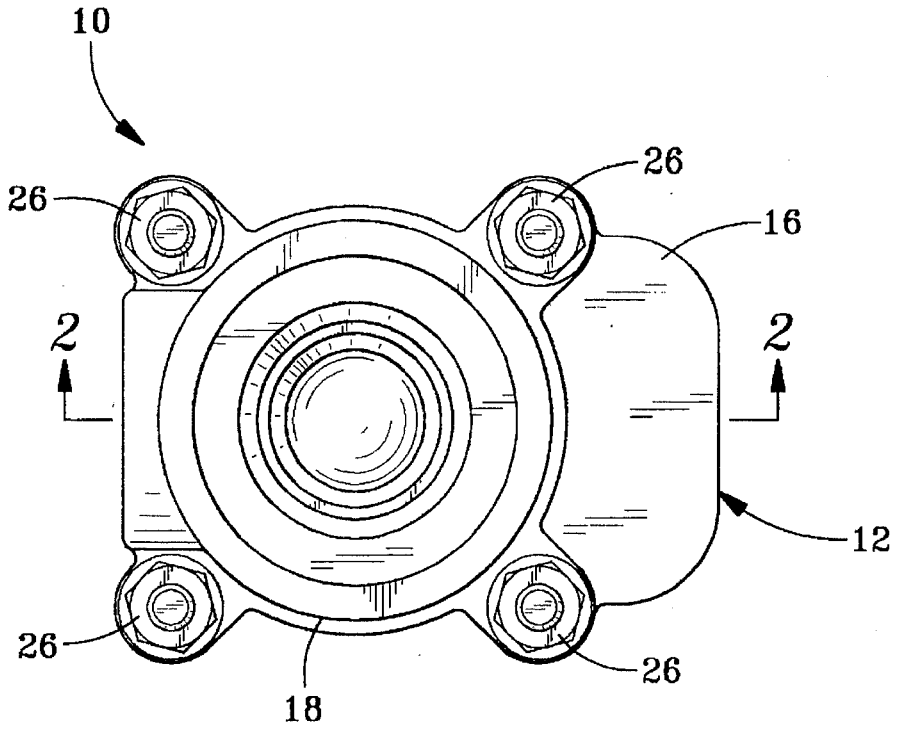
FIG. 1 is an end view of the reciprocating pump of the present invention.

Referring now to the drawings, wherein similar reference characters designate corresponding parts throughout the several views, FIG. 1 shows the reciprocating pump of the present invention generally indicated at 10. The pump 10 is a non-divorced type of pump known to one skilled in the art. The pump includes a power source 12 which may be a reciprocating piston-type motor or any other suitable motor which provides reciprocating motion. The motor includes a housing 14 which has a first open end 16 and a chamber 17. A reciprocating member 18 is displaced by the motor along a linear path defined by axis 20 through chamber 17 during motor operation. The reciprocating member has a free end 22 which extends through the open housing end and away from the motor.

A motor base 24 is adapted to be located on the first end 16 of motor housing 14 and in this way substantially closes the open first end. The motor base has a hub 28 that is made integral with the base and is inserted in the end of housing chamber 17 when the base is seated on end 16. See FIG. 2. In this way, the base is located in the proper position on the housing end 16.

The base includes a stepped passageway 30 that extends through the base 24. The passageway is narrowest at the hub and is widest away from the hub. The reciprocating member is adapted to be movable through the passageway. A seal 32 is sandwiched between the base and a bushing 34 that is seated in the wide portion of the passageway 30.

Figure 2:
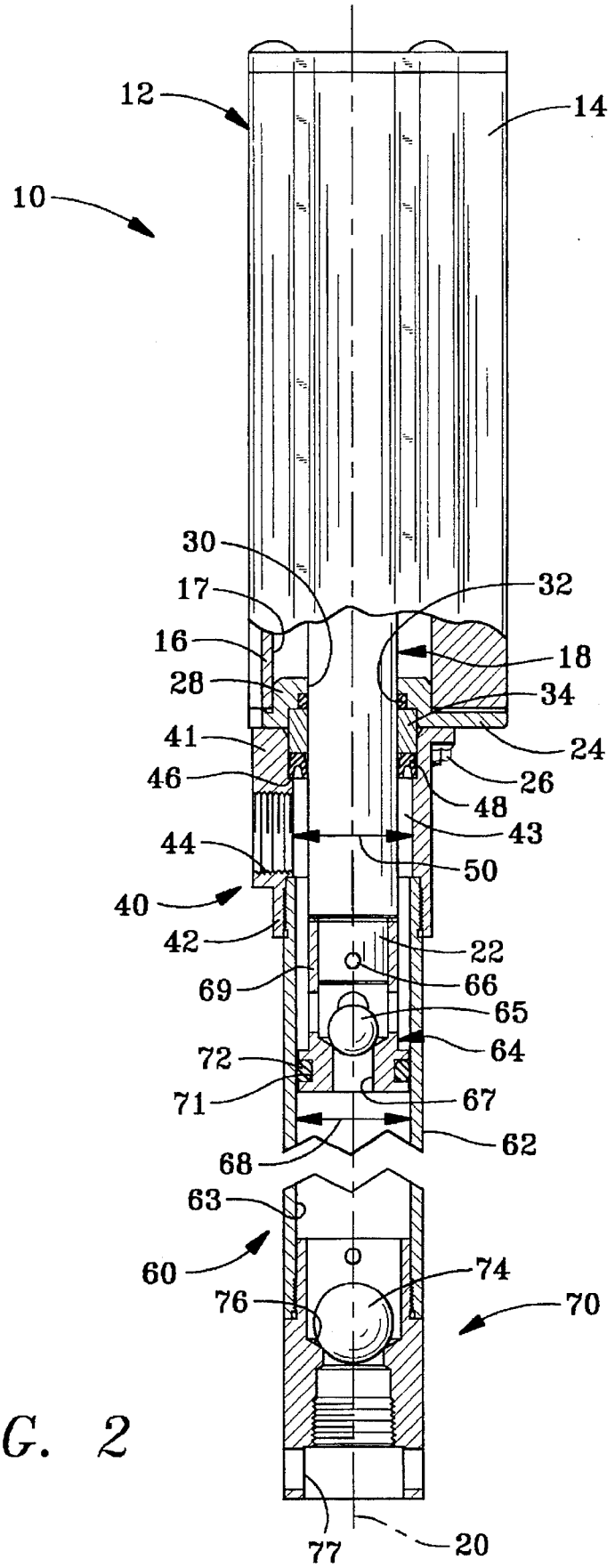
FIG. 2 is a sectional view taken along line 2—2 of FIG. 1.

A pump outlet body 40 is connected to the motor base 24 by four conventional fasteners 26. The fasteners may be any suitable connector means for example tie-rods, bolts or the like. The pump outlet has a cylindrical body with a first end 41 a second end 42 and an outlet port 44 located between the ends. A passageway 43 extends between the ends. A service line (not shown) may be flow connected to the outlet port 44 and thereby provide a conduit for the fluid pumped by the pump reciprocating to be flowed to an object of interest. The outlet body includes a shoulder 46 and a seal member 48 is sandwiched between the shoulder and the bushing 34 as shown in FIG. 2. The inner periphery of the seal member 48 is located in passageway 43 of the pump outlet 40. The reciprocating member extends through the passageway 43 formed in the outlet body and is adapted to be movable through the passageway. The passageway 43 has a minimum width identified as 50 in FIG. 2.

The seals 32 and 48 sealingly engage reciprocating member 22 during operation of pump 10.

Pump 60 is threadably flow connected to the outlet body 40 at the second end 42 of the outlet body. The pump includes an elongate pump tube 62 with one end of the tube connected to the outlet body and the opposite end of the tube threadably connected to a conventional foot valve 70 well known to one skilled in the relevant art.

Figure 3:
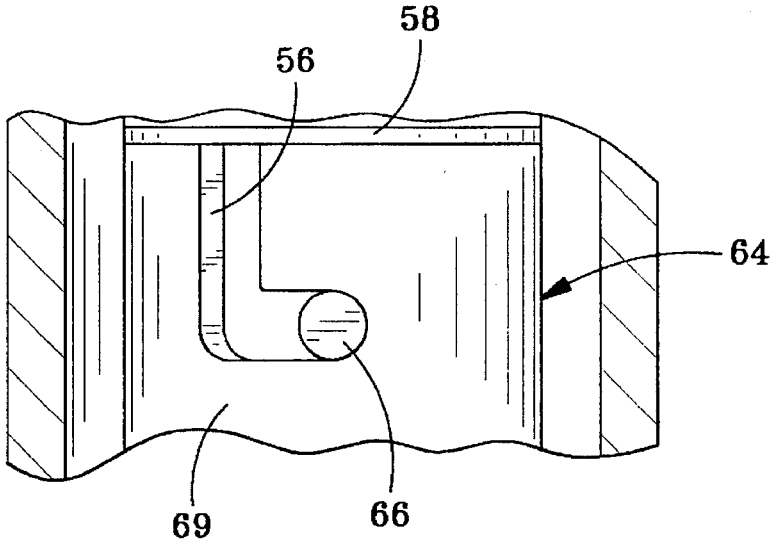
FIG. 3 is a detailed view of showing the connection between the reciprocating member and the check valve cage.

The movable end 22 of reciprocating member 18 extends into the pump tube adjacent the end of the pump tube connected to outlet second end 42. The cage 69 of a conventional pump inner check valve 64 is operatively connected to the end 22 of member 18 by a conventional pin connection 66 and is thereby movable through the piston tube chamber 63 with the reciprocating member. The pin is passed through circular openings formed in the cage. A spring member 58 such as a wave washer or bowed washer is sandwiched between the top end of the inner check valve cage and the end of the member 18 as shown in FIG. 3. The spring prevents the cage from becoming disconnected from the end of member 18. Alternately, rather than a conventional pin connection, the cage may be provided with a pair of L-shaped slots 56. See FIG. 3. The pin 66 is located in the horizontal portion of the slots to connect the cage 69 and member 18. The slots are formed along the portion of the cylindrical cage body adjacent spring washer 58 and are positioned along opposite sides of the cage. The two slots are separated by approximately 180 degrees. The spring washer maintains the pin 66 in the slot during operation of pump 10. When it is necessary to separate the cage and member, the cage is manually rotated clockwise approximately 35 degrees until the pin is aligned with the vertical portion of the L-shaped slot, the cage may then be removed from the end of the member 18.

The inner check is of a design well known to one skilled in the art and includes a check ball 65 which is seated in seat 67. An annular groove 71 is formed along the inner check body and a seal 72 is seated in the groove. As shown in FIG. 2, the check has a width 68. The width of the check is less than the minimum width 50 of outlet body passageway 43 and is greater than the width or diameter of the reciprocating member. Seal 72 forms a dynamic seal with piston tube chamber and a static seal with the inner check during operation of pump 10.

The foot valve includes a check ball 74 which is seated in seat 76. The pumped fluid enters the pump 60 through inlet 77 in the bottom of the foot valve.

The pump 60 is typically immersed in a fluid such as grease or oil which is stored in a drum, tank or the like. The pump motor is mounted on the outside of the drum or tank.

Operation of the pump 10 will now be described. After the pump 60 is immersed in the media to be pumped, the motor 12 is mounted on the drum, power is supplied to the motor and the member 18 is displaced upward along axis 20. As the member is moved upward, inner check ball 65 seals against seat 67 and a vacuum is formed in chamber 63. This vacuum draws the lower check ball 74 off seat 76 and fluid is drawn from the drum chamber through inlet 77 into piston tube chamber 63.

When the pump member 18 is displaced downward, by motor 12, lower check 74 is forced to seal on lower seat 76. The fluid in chamber 63 forces check ball off seat 67 allowing the fluid to flow to passageway 43.

When the member 18 is displaced upward, the fluid in passageway 43 is forced out port 44 through a supply line to an object of interest. Ball 65 is seated in seat 67, ball 74 is displaced upward and additional fluid is drawn into chamber 63. The process is continuously and rapidly repeated.

The pump transfers media efficiently when proper seals are formed in the pump. In order to ensure that proper seals are formed, seal members 72 and 48 must be checked and replaced on a regular basis. In known reciprocating pumps, checking the seals can be difficult. However, the present invention simplifies seal maintenance. When it is necessary to supply maintenance to the pump seals, the fasteners 26 are removed and motor housing 14 is slid off the pump. Then the reciprocating member 18 and base 24 are together lifted off the outlet body 40. As the reciprocating member is moved off the outlet body, the inner check moves with the member. Since the width of the inner check is less than the minimum width of the passageway 43, the inner check is movable through the passageway. As the inner check approaches body end 41, the inner check engages the seal 48 and bushing 34 and displaces the seal and bushing upward and out of outlet 40. In this way, the seals are easily maintained. It is not necessary to disconnect the outlet from the supply line in order to check the seals. The seals are serviceable with the pump in line.

Also, the cage of inner check valve 64 is easily disconnected from the reciprocating member making maintenance to the check valve ball 65 relatively easy.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A reciprocating pump serviceable in-line, the reciprocating pump comprising:

a) a reciprocating power source having a housing body which includes an open first housing end and a housing body base at the first housing end, said housing body base for substantially closing the first housing end, b) said reciprocating power source connected to a reciprocating member movable by said reciprocating power source, said member having a width and, a reciprocating member end, said member being adapted to be movable through a housing body chamber along an axis;

c) a pump outlet body having a first outlet body end, a second outlet body end, a pumped fluid outlet between the outlet body ends, a passageway joining said outlet body ends and adapted to receive the reciprocating member, said passageway having a passageway wall, and a minimum width, and a seat formed in the passageway wall between the outlet body ends, the pump outlet body being connected to the housing body base;

d) first seal means substantially located in the seat, said first seal means for forming a seal with the reciprocating member, said first seal means having an inner periphery located in said passageway in order to sealingly engage the reciprocating member;

e) connecting means for connecting the outlet body to the housing body base;

f) pump means adapted to be flow connected to the second end of the pump outlet body, said pump means having a movable means for displacing the pumped fluid to the pumped fluid outlet, said movable means being operatively connected to said reciprocating member end, said movable means also having a width that is less than the minimum width of the passageway and greater than the width of the reciprocating member, said movable means adapted to engage the inner periphery of the first seal means when the reciprocating member is moved along the axis and removed from the passageway and thereby lifts the first seal means from the seat and out of the passageway, said movable means further including at least one L-shaped opening each adapted to accept a pin member located at the end of said reciprocating member, said pump means further including a wave washer sandwiched between the movable means and reciprocating member to maintain the pin in the openings and thereby prevent the movable means and reciprocating member from disconnecting.

2. The reciprocating pump as claimed in claim 1 wherein the housing body base has a stepped passageway extending through the housing body base.

3. The reciprocating pump as claimed in claim 1 wherein the pump means includes a tubular pump tube with a pump tube wall, and where said pump means movable member is a check valve having a cage member, and a second seal seated in the cage member, wherein said second seal sealingly engages the pump tube wall.

4. The reciprocating pump as claimed in claim 1 wherein the pump means movable means is a check valve assembly.

5. The reciprocating pump as claimed in claim 4 wherein the reciprocating pump has a second seal between the base and the outlet body and the pump means check assembly includes a third seal.

6. A reciprocating pump comprising:

a) a reciprocating power source having a substantially open first end;

b) a reciprocating member connected to the reciprocating power source, said reciprocating member having a width and a first end that extends through the substantially open first end of the reciprocating power source;

c) a pump outlet connected to said reciprocating power source, said pump outlet having a body with a first pump outlet end, a second pump outlet end, and a pumped fluid outlet between the pump outlet ends, the body defining a passageway having a passageway wall, a seat formed along the wall of the passageway, the passageway having a passageway width and adapted to permit the reciprocating member to be moved along an axis through the passageway;

d) first seal means located in said seat and including an inner periphery located in said passageway and adapted to sealingly engage said reciprocating member;

e) pump means flow connected to the second end of said pump outlet body, said pump means for flowing a fluid into and through the pumped fluid outlet, said pump means including a check valve assembly that includes a cage, said cage being connected to said first end of said reciprocating member to be moveable with said reciprocating member, said cage having a cage width that is greater than the width of the reciprocating member and is less than the width of the passageway, thereby said cage is adapted to engage the inner periphery of said first seal and move the seal out of said seat when the reciprocating member is removed from the pump, said cage further including at least one L-shaped opening each adapted to accept a pin member located at the end of said reciprocating member, and said pump means further including a wave washer sandwiched between the cage and reciprocating member to maintain the pin in the openings and thereby prevent the cage and reciprocating member from disconnecting.

7. The reciprocating pump as claimed in claim 6 wherein there are two openings.

* * * * *